US005662268A

United States Patent [19]

Katzenberger

[11] Patent Number: 5,662,268

[45] Date of Patent: Sep. 2, 1997

[54] THERAPEUTIC DRINKING STRAW MACHINE

[75] Inventor: Kathy Katzenberger, Evanston, Ill.

[73] Assignee: Kathy Murray, Northlake, Ill.

[21] Appl. No.: 490,754

[22] Filed: Jun. 15, 1995

[51] Int. Cl.[6] ..... A47G 21/18

[52] U.S. Cl. ..... 239/33; 239/154; 239/331

[58] Field of Search ..... 239/33, 24, 16, 239/329, 331, 333, 153, 154; 414/9; D7/300, 300.2; D24/112–114, 117; 604/247, 249, 256, 257, 260; 222/383.3, 321.8, 321.1, 321.7, 175, 608, 610, 628

[56] References Cited

U.S. PATENT DOCUMENTS

| | | | |
|---|---|---|---|
| 2,756,740 | 7/1956 | Deane | 604/77 |
| 3,346,187 | 10/1967 | Mueller | 239/33 |
| 4,196,747 | 4/1980 | Quigley et al. | 239/33 X |
| 4,909,437 | 3/1990 | Kang | 239/33 |
| 5,222,940 | 6/1993 | Wilk | 239/33 X |
| 5,361,987 | 11/1994 | Mattheussen et al. | 239/33 |

OTHER PUBLICATIONS

"Nosey Cups"; Crestwood Helpline Service Catalog; Mar. 1, 1995; 1 page.

"Flo–Trol® Feeding Cup"; Crestwood Helpline Service Catalog; Mar. 1, 1995; 1 page.

"One–Way Straws"; Sammons, Inc. Catalog; Circa 1990; 1 page.

"Dysphagia Cup" Brochure; Dysphagia Cups of Bremerton, WA; Circa 1991; 2 pages.

*Primary Examiner*—Lesley D. Morris
*Attorney, Agent, or Firm*—Leydig, Voit & Mayer, Ltd

[57] ABSTRACT

A liquid delivery device for swallowing-impaired users comprising a dip tube disposed in a liquid source, a delivery straw for receipt in the user's mouth, and a pumping mechanism disposed between the dip tube and the delivery straw for conveying liquid from the source to the mouth of the user. The pumping mechanism includes a manual actuator and a central reservoir such that actuation of the actuator empties the reservoir, and return of the actuator to a rest position re-fills the reservoir.

20 Claims, 5 Drawing Sheets

THERAPEUTIC DRINKING STRAW MACHINE

FIELD OF THE INVENTION

The invention relates generally to feeding devices and more particularly to a therapeutic drinking straw for delivering liquids to motorically-impaired or cognitively-impaired individuals with swallowing difficulties.

BACKGROUND OF THE INVENTION

Difficulty in swallowing, leading to a decreased ability to move food and liquid from the mouth to the stomach, is referred to as dysphagia. Oropharyngeal dysphagia is divided into two primary phases: 1) oral phase swallowing impairments, in which the patient has difficulty moving the prepared food or liquid (referred to as a "bolus") to the pharynx; and 2) pharyngeal phase swallowing impairments, in which the patient encounters difficulty moving the bolus through the pharynx into the esophagus.

A patient suffering from either type of dysphagia may encounter medical complications, such as aspiration and dehydration. Aspiration, wherein all or part of the bolus penetrates the airway below the level of the vocal folds, is commonly encountered by patients whose dysphagia results from cognitive impairment. Impairments in attention, judgement and memory may preclude such individuals from using safe swallowing techniques. Thus, while the motor skills for swallowing thin liquids may be present, the patient may not remember to take small sips or to appropriately monitor his rate of intake, resulting in aspiration. Dehydration resulting from dysphagia often occurs in patients with severe oral motor deficits, as their reduced oral motor function may cause profuse oral spillage while drinking.

A variety of techniques are presently employed in an attempt to insure that dysphagic patients receive adequate hydration. Liquids thickened with a commercial thickening agent are often recommended as an alternative to thin liquids for dysphagic patients who do not self-regulate the size and rate of liquid intake. Thickened liquids, however, are generally not as desirable to patients as thin liquids, due to taste and texture alteration. The undesirable quality of thickened liquids may lead to reduced consumption. Alternatively, thin liquids may need to be administered by trained personnel thus adding to the costs in solving this problem. While conventional straws may also be used to deliver thin liquids to dysphagic persons, they too may also present significant problems. For example, use of such straws is not appropriate for dysphagic persons with decreased cognition since they cannot monitor the rate or the amount of liquid swallowed. Additionally, oral motor impairments may lead to a difficulty in sucking liquid through a traditional straw because of a reduced lip seal around the straw.

It has been determined that the risk of choking by dysphagic patients may be reduced by drinking with a chin-down head position. Accordingly, therapeutic drinking cups designed to promote such a chin-down head position have been developed and used. One such cup (a "Nosey Cup") includes a cut-out for the patient's nose so that the cup can be tipped to a drinking position with the chin down. A so-called "Dysphagia Cup" has also been developed, which is internally and externally contoured to promote drinking with a chin down head position. While these devices may prevent choking in dysphagic patients, they do not in any way control the rate or the amount of intake of the liquid.

Thus, while equipment and techniques have been developed for assisting dysphagic patients, they are not entirely satisfactory.

SUMMARY OF THE INVENTION

It is thus a primary aim of the present invention to provide an improved liquid delivery device as compared to those that have been used heretofore.

In accordance with that aim, it is a primary object of the invention to provide a liquid delivery device for use by users suffering from swallowing impairments due to cognitive disorders, behavioral disorders, and/or oral motor deficits which foreclose them from drinking liquids through conventional methods.

It is a further object of the invention to provide a liquid delivery device that delivers a controlled and repeatable volume of liquid by user self-administration.

It is a further object of the invention to provide a liquid delivery device with a controlled rate of delivery.

It is a still further object to provide a liquid delivery device that requires minimal oral motor skill on the part of the user.

It is an even further object to provide a liquid delivery device that promotes a chin down drinking position.

It is an additional object to provide a liquid delivery device wherein the amount of liquid delivered to and consumed by the user may be determined.

It is also an object of the invention to provide a liquid delivery device that may allow for reduced use of medical personnel in administering thin liquids to the dysphagic user.

In accordance with these and other objects and advantages of the present invention, a liquid delivery device is provided in the form of a straw including a manually-actuated pump having a reservoir of a predetermined size, such that actuation of the pump controllably delivers a defined volume of liquid to the dysphagic or other user. The liquid delivery device, according to the invention, includes a dip tube leading from the pump mechanism to a source of liquid to be consumed by the user. A bendable delivery straw leads from the pump to the mouth of the user which assists in promoting a chin down drinking position. The pump is designed such that the contents of the reservoir is delivered through the delivery straw to the mouth of the user when the pump mechanism is actuated. Toward that end, the pump mechanism includes a manual actuator. The actuator is movable from a rest position to an actuated position (causing the liquid in the reservoir to be expelled through the delivery straw), and also being moveable from the actuated position to the rest position (causing liquid to be drawn from the liquid source through the dip tube to re-fill the reservoir). A lower one-way valve between the reservoir and the dip tube prevents back flow of liquid out of the reservoir and into the source. At the same time, the lower one-way valve allows liquid from the source to re-fill the reservoir as the pump mechanism relaxes from its actuated position. An upper one-way valve between the reservoir and the delivery straw prevents backflow of liquid and air from the delivery straw to the reservoir.

In this manner, the pump mechanism thus controllably delivers a repeatable volume to the user. The pump delivers the liquid to the user in a slow manner, thus precluding potential premature spillage over the tongue into the pharynx. The user may gently suck on the straw as the liquid is dispensed to simulate normal straw usage. The upper-one-way valve, however, effectively prevents liquid being sucked from the device unless the actuator is actuated. In a preferred embodiment, a resilient member in the pump handle is provided to return the actuator to the rest position, and also allows programming of the speed by which the liquid is dispensed to the user. In addition, the diameter of the delivery straw may be slightly larger than a regular straw and includes a ridged surface for increased tactile information. The larger diameter and ridged surface may make it easier for persons with decreased lip strength to hold the straw in their mouth. The preferred embodiment also includes a rigid plastic sheath surrounding the dip straw, and a filter associated with the dip straw to provide added structural stability to the device, and to prevent intake of any large particles into the pump mechanism, respectively. The dip tube of the device may be inserted into a graduated cylinder to provide added stability to determine the amount of liquid consumed, Various other inventive features of the invention will be apparent from the description of the invention provided herein.

DETAILED DESCRIPTION OF THE PREFERRED EMBODIMENTS

While the invention will be described with reference to the preferred embodiments, it will be obvious to those of ordinary skill in the art that variations of these preferred embodiments may be used and it is intended that the invention may be practiced otherwise than as specifically described herein. Accordingly this invention includes all modifications and equivalents encompassed within the spirit and scope of the invention as defined by the appended claims.

The liquid delivery device according to the invention is designed to controllably deliver a repeatable quantity of liquid to dysphagic patients or other users. Toward that end, the liquid delivery device combines aspects of a conventional straw with a pump mechanism for conveying the liquid from a liquid source, and delivering that liquid to the user. The pump action of the device allows a user to receive liquid through a straw-like device without having to exert the normal amount of oral suction required for straw use. This is particularly advantageous since many dysphagic patients suffer from reduced oral motor skills, and thus reduced ability to achieve the necessary sucking function. At the same time, the pump mechanism also allows the amount and rate of delivery of the liquid to be accurately controlled.

Figure 1:
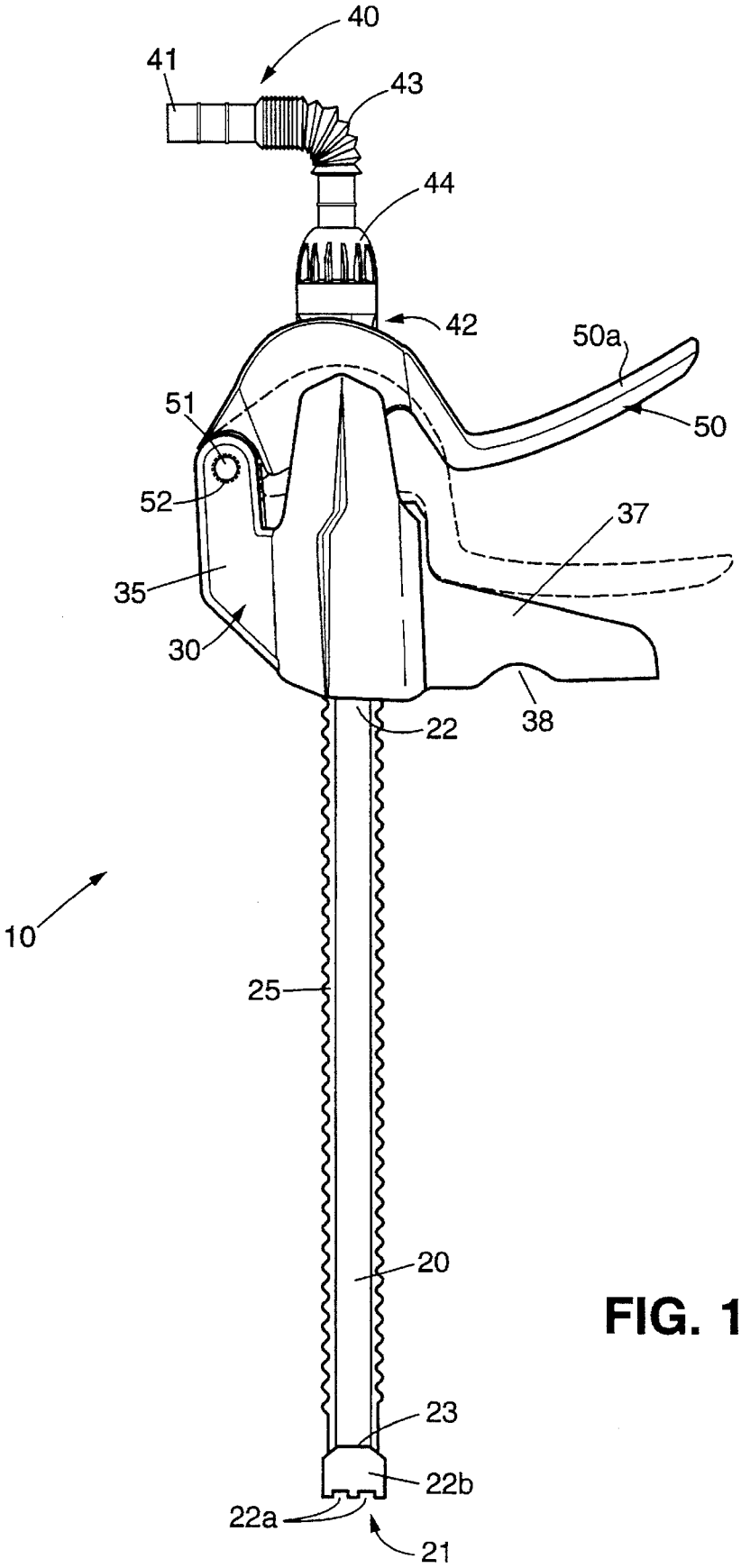
FIG. 1 is an elevational view of the therapeutic drinking straw according to an embodiment of the invention provided herein.

To achieve these and other advantageous functions, the liquid delivery device 10, shown in FIG. 1, generally includes a dip tube 20, a pump mechanism 30 and a delivery straw 40. The dip tube includes a first end 21, adapted to be immersed in the source of liquid to be delivered to the patient. The liquid source will typically be retained within a container with which the liquid delivery device is associated. The delivery device 10 is shown in combination with such a container, which retains a liquid source 110, in FIG. 2. That liquid source 110 is illustratively retained in a graduated cylinder 100 including volumetric markings 115. A graduated cylinder is advantageously employed for use with the liquid delivery device 10 so that the exact quantity of liquid consumed by the patient may be determined. Further, the rigidity of the graduated cylinder adds stability to the device. A lid 111, includes a central hole 112 sized to receive and maintain the dip tube 20. Returning to FIG. 1, dip tube 20 also includes a second end 22 coupled to the pump mechanism 30. To ensure flow of liquid from the liquid source into the dip tube 20 even in the event that the first end 21 is at the bottom of the liquid source container, a tube ending **22*b* having feet 22*a* for fluid passage, may be employed. Further, a ridged sheath 25 may surround dip tube 20 to add structural reinforcement to the tube 20**.

The delivery straw 40 also includes a first end 41 and a second end 42, with the second end being coupled to the pump mechanism 30. To allow for a dysphagic patient or other user with reduced oral motor function to adequately grip the first end 41 of the delivery straw 40, first end 41 may have a greater diameter than a conventional straw, and may include ridges. Delivery straw 40 also preferably includes a bend 43 intermediate its two ends. This bend in the delivery straw helps to promote a chin down drinking position.

To convey liquid from the liquid source to the mouth of the user, the pump mechanism is disposed between and coupled to the second ends 22 and 42 of the dip tube 20 and delivery straw 40, respectively. The pump mechanism 30 includes an internal reservoir of a defined volume. The controlled delivery of this defined volume to the user forms a significant aspect of the invention.

Figure 4:
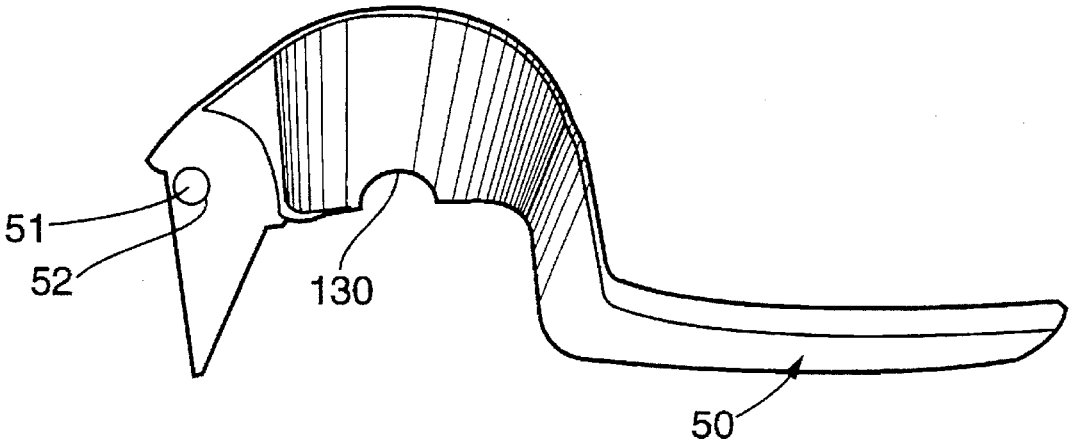
FIG. 4 is a side view of the actuator according to an embodiment the invention.
Figure 3:
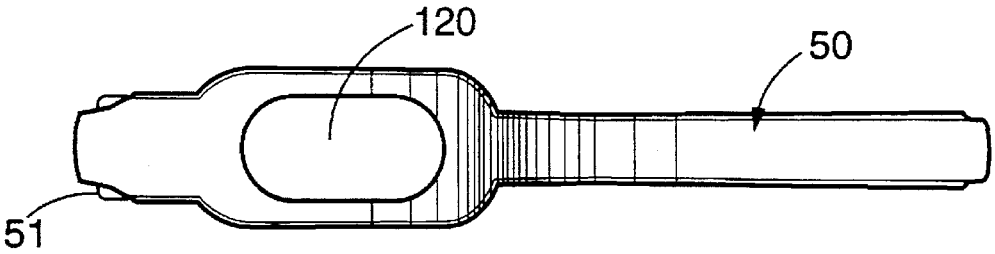
FIG. 3 is a top view of the actuator according to an embodiment of the invention.

To provide for that controlled delivery of the defined volume of liquid from the reservoir in the pump mechanism 30 to the user, liquid delivery device 10 includes a manual actuator 50 which, in the present embodiment, is movably coupled to a pump housing 35 of the pump mechanism. The movable coupling, according to the present embodiment is in the form of a rotational coupling provided by an axle 51 disposed on actuator 50. A top view of the actuator 50 is shown in FIG. 3, and a side view is shown in FIG. 4. That axle is, in turn, received within holes 52 formed on either side of actuator 50 in the pump housing 35. The movable coupling between actuator 50 and pump housing 35 allows movement of the actuator 50 between a rest position shown in solid lines in FIG. 1, and an actuated position shown in phantom in FIG. 1. According to the invention, and as described below, the liquid delivery device 10 is designed to expel the contents of the reservoir inside the pump mechanism 30 (through delivery straw 40 and into the mouth of the user) upon movement of the actuator 50 from the rest position to the actuated position. The device is further designed to draw liquid from the liquid source through dip tube 20 and into the reservoir in the pump mechanism 30 (thus re-filling the reservoir) upon movement of the actuator from the actuated position to the rest position. That is, repeated movement of the actuator 50 between the rest position and the actuated position results in a pumping action controllably moving defined quantities of liquid from the liquid source, through the reservoir, and to the mouth of the user. To assist in manual actuation of the actuator 50, pump housing 35 includes a handle 37 opposed to the actuator 50 and including an indentation 38 for receiving the user's thumb.

According to the present embodiment, movement of the actuator results in this pumping action by virtue of actuator 50 being operatively coupled to a plunger that reciprocates within a well in the pump housing under the action of the actuator. The plunger 80 is shown in position within the pump housing 35 in the sectional view of FIG. 5. An elevation of the plunger 80 is shown in FIG. 6. Plunger 80 includes a main body portion 81 and a circular head 82. The circular head or gasket 82 may be integral with plunger 80. Alternatively, gasket 82 may be formed on a cylindrical insert for insertion into a central cavity in the plunger 80. In either event, circular head 82 of the plunger 80 is preferably formed of a slightly deformable material, and has a diameter substantially equal to the inner diameter of the cylindrical well 60, thus forming a sliding seal to prevent flow of liquid past the head as the plunger reciprocates within the well 60.

Figure 7:
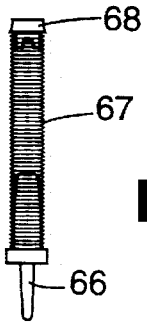
FIG. 7 shows the lower one-way valve according to an embodiment of the invention.

To allow fluid flow from the liquid source into the well 60, the pump housing 35 includes an inlet 63. In the present embodiment, a central shaft 62 is disposed within the cylindrical well 60, and is in fluid communication with inlet 63 to the pump housing, which is in turn in fluid communication with the dip tube 20. Liquid thus enters the well 60 by flowing through inlet 63, up through shaft 62 and into well 60. To regulate fluid flow through inlet 63, shaft 62 also houses the lower one-way valve (seen in detail in FIG. 7) in the form of a valve member 66 and a spring 67. A cap 68 fits within shaft 62 to retain the spring 67 in the shaft. While other specific constructions of one-way valves may be used, all such configurations would share the functional feature of only allowing fluid flow from dip tube 20 into well 60 when a sufficient force is exerted on the valve member 66 allowing valve member 66 to unseat from inlet 63. In the present embodiment, this occurs when the force exerted on valve member 66 is sufficient to overcome the force of spring 67 tending to force valve member 66 to seat in the inlet 63. At all other times (i.e. when the valve member is seated) the lower one-way valve prevents downward flow through the inlet 63.

Figure 9:
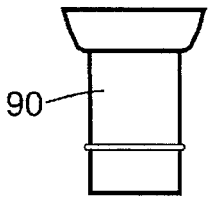
FIG. 9 shows a side view of the cap insert according to an embodiment of the invention.
Figure 10:
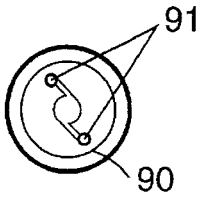
FIG. 10 shows a top view of the cap insert according to an embodiment of the invention.
Figure 8:
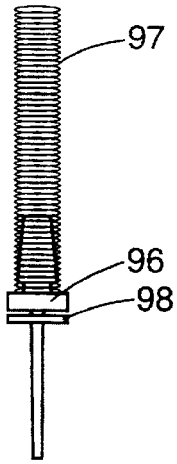
FIG. 8 shows the upper one-way valve according to an embodiment of the invention.

The plunger 80 also includes a central cavity 87 and a central opening 88 in fluid communication with both the central cavity 87 and an upper cavity 89. A cap 90 (shown in FIGS. 8 and 9) is received within the upper cavity 89, and itself includes at least one central opening 91 in fluid communication with the delivery straw 40 (two openings are shown in FIG. 9). To regulate fluid flow through central opening 88, and thus through central openings 91, the cap houses the upper one-way valve (shown in detail in FIG. 8) including a valve member 96 and a spring 97. The function of the upper one-way valve is similar to the lower one-way valve in that fluid flow is only allowed upward through the central opening 88 when a sufficient force is exerted on valve member 96 so as to overcome the force of spring 97 tending to seat the valve member 96 in the opening 88. Downward flow through central opening 88 is prevented by the upper one-way valve. In the preferred embodiment, an O-ring 98 is provided between valve member 96 and opening 88 to enhance sealing.

Reciprocation of the plunger 80 by movement of the actuation member 50 provides the pumping action according to the invention. As the plunger is moved from the raised position shown in FIG. 2 to a lowered position where the circular head is adjacent to the bottom of the well 60, the liquid contents of the well 60 and central cavity 87 (if any) is expelled through central opening 88, and through opening 91 in the cap 90, to and through the delivery straw 40. The lower one-way valve prevents the liquid from flowing downward through inlet 63 during this action. The contact between the circular head 82 of the plunger 80 and the walls of the well 60 prevents any flow past the head 82. Accordingly, the fluid being compressed by the lowering plunger exerts sufficient force on the upper check valve to unseat the valve member 96 from the central opening 88, thus allowing the fluid to flow out of the well 60 and central cavity 87.

Figure 2:
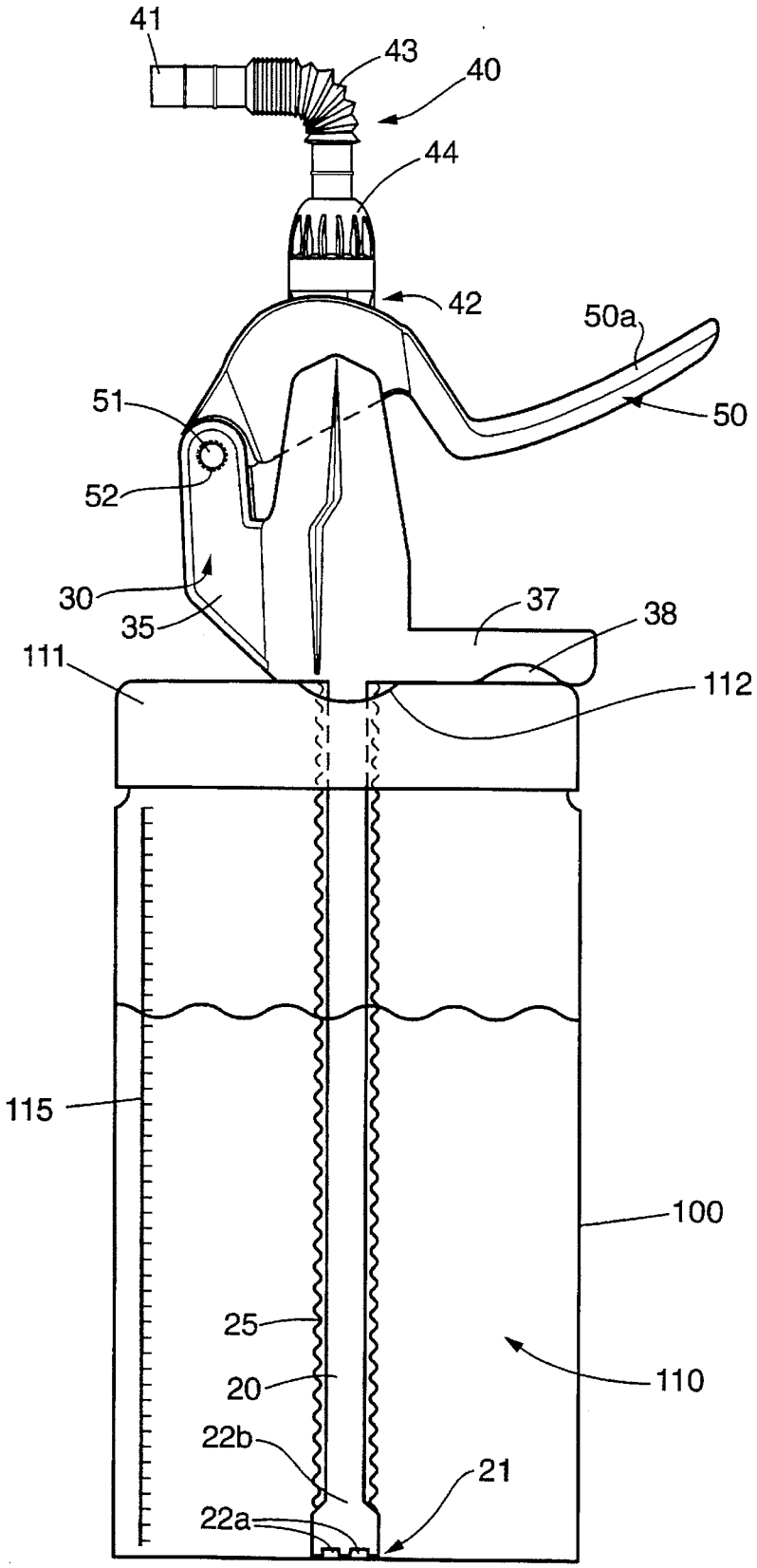
FIG. 2 is an elevational view of the therapeutic drinking straw system including a graduated cylinder.

Conversely, as the plunger 80 is moved from a lowered position, where the head 82 is disposed adjacent the bottom of the well 60, to the raised position of FIG. 2, liquid is drawn through the dip tube, through inlet 63, and into the well 60 and central cavity 87. The upper check valve prevents any liquid or air from flowing downward through the central opening, and the contact between head 82 and the walls of the well 60 prevents any air from flowing past the head. As a result, upward movement of the plunger creates a negative pressure in the well 60 and central cavity 87. This negative pressure is large enough to exert a sufficient force on the valve member 66 of the lower one-way valve to cause that valve member to unseat. Once it is unseated, the negative pressure sucks liquid up from the dip tube 20 in the liquid source and into the well 60 and central cavity 87, thus re-filling the reservoir formed by the well 60 and central cavity 87.

The plunger is reciprocated downward by the actuator 50. As seen in the top and side views of the actuator 50 (FIGS. 3 and 4), actuator 50 includes an opening 120 through which the upper portion of the plunger 80 (FIG. 6) passes. Plunger 80 also includes engaging extensions 125, which are diametrically opposed on the plunger. These engaging extensions are received within recesses 130 on the actuator 50. Thus, as the actuator 50 is moved between the rest position and actuated position (solid and phantom position in FIG. 1), the recesses 130 engage the engaging extensions 125 on the plunger 80 and force the plunger downward.

Figure 5:
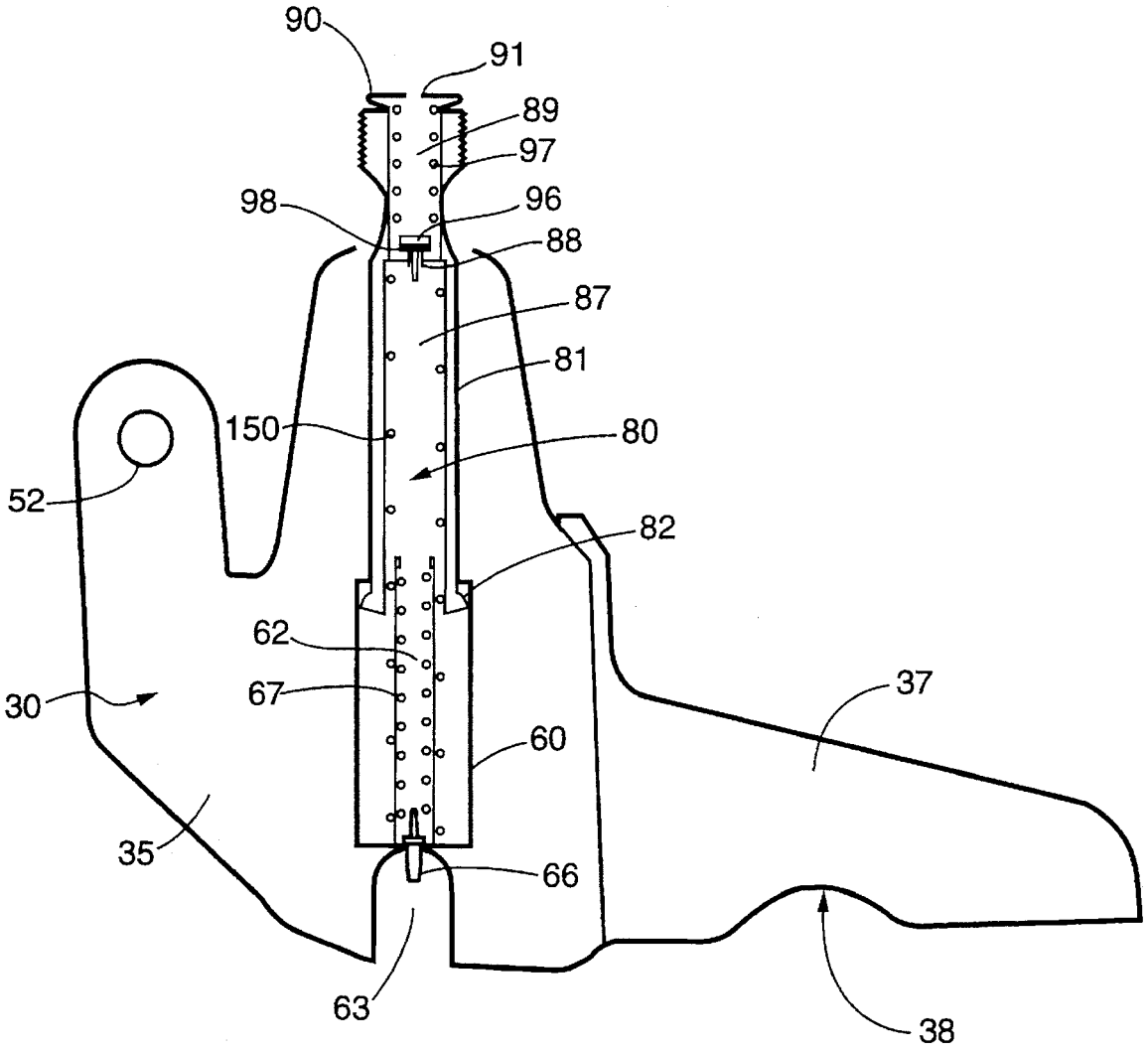
FIG. 5 is a partial cut-away view of the pump mechanism according to an embodiment of the invention.
Figure 6:
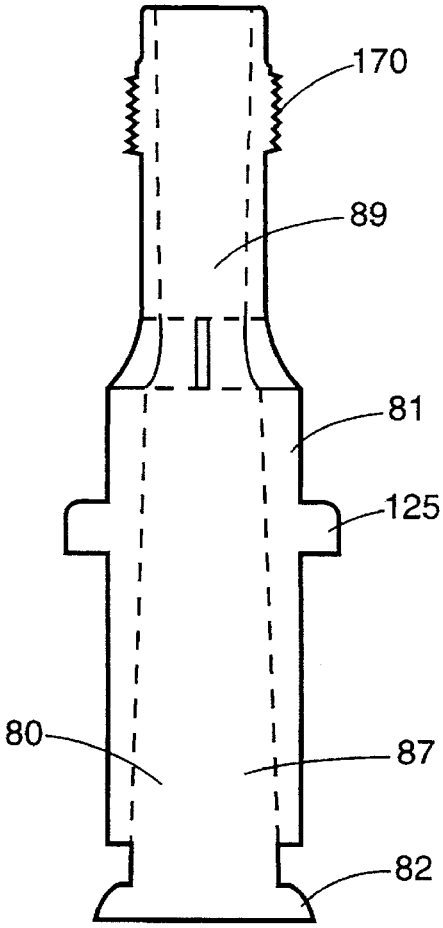
FIG. 6 shows the plunger according to an embodiment of the invention.

While upward movement of the plunger 80 could, within the scope of the invention, be provided by engagement with and movement of the actuator 50, the upward movement according to the present embodiment is provided by resilient member in the form of a spring 150, shown in FIG. 5. The spring 150 is disposed between the bottom of the well 60 and the upper surface of the central cavity 87 in the plunger 80 in the present embodiment. Thus, spring 150 is coupled to the housing and, indirectly, to the actuator 50 through plunger 80. It will be appreciated by one skilled in the art that, since the spring 150 is intended to move the actuator from the actuated position to the rest position, the spring 150 may be disposed between other locations on the housing 35 and actuator 50. For example, spring 150 could be disposed between the handle portion 50*a* of actuator 50 (FIG. 1) and the opposed handle portion 37 of the housing 35. Regardless of the exact position of spring 150, as the plunger is lowered by the action of the actuator 50, the spring 150 is compressed. When actuator 50 is released, this compressive force translates the plunger 80 upward, thus creating the negative pressure required to re-fill the reservoir.

According to an advantageous feature of the invention, the strength of spring 150 may be selected to control the necessary force that must be exerted on actuator 50, to actuate the pump mechanism 30. The stiffer the spring 150, the more slowly will actuator 50 be moved from the rest to the actuated position. Thus, by properly selecting the stiffness of spring 150, the rate of delivery of the liquid from the reservoir to the user's mouth may be adequately and desirably controlled. The automatic movement of the actuator from the actuated position back to the rest position, as provided by spring 150, also insures that the reservoir is properly re-filled following each emptying of the reservoir by movement of the actuator 50 to the actuated position. The relaxation time of the spring (the time required for the actuator 50 to be moved from the actuated to the rest position) also provides the device according to the invention with an inherent time delay. That is, after actuation of the actuator, the user cannot receive a second administration until the spring 150 has returned the actuator 50 to the rest position. Such a feature is often necessary with cognitively-impaired patients who have difficulty with controlling their rate of intake. Finally, for severely motor impaired patients, a significantly less stiff spring may be necessary so as to allow easier actuation of the actuator 50 by the user.

The size of the bolus delivered to the patient is determined by the specific geometry of the well 60 and the internal cavity 87. Typically, this geometry is selected so that the bolus size is approximately 5 ml. By virtue of the pumping action, according to the invention, this repeatable bolus size may be slowly and controllably delivered into the patients mouth by actuation of the pump mechanism. Following this, and upon re-filling of the reservoir, a quantity of liquid may be retained in upper straw 40 above the upper one way valve. This additional liquid, assuming a user of sufficient oral motor skill, could be sucked out of the upper straw. If this occurs the next actuation of the device would not deliver the full bolus size, but rather the mechanism would need to be re-primed so that the upper straw portion contained liquid. Of course, one skilled in the art will appreciate that before initial use of the device, the system must be primed to fill the reservoir before successful pumping action can occur. Toward this end, the user may need to receive some minimal instruction to ensure correct usage of the device.

The liquid delivery device, according to the invention, is also designed with features that make it easy to disassemble for cleaning purposes. For example, as seen is FIG. 6, the plunger 80 includes threading at its upper end as at 170. A cap 44 on the delivery straw 40 (see FIG. 1) adjacent the second end 42 of that delivery straw, includes internal threading for receipt on the threading 170 of the plunger 80. This allows the delivery straw 40 to be screwed off the pump housing 35 for the purpose of cleaning and for replacement if damaged. Additionally, dip tube 20 may be removable from the inlet 63 of the pump housing 35 to also facilitate cleaning. To prevent large objects or pieces of material from entering the dip tube 20, a screen filter 23 may be put in place across the first end 21 to prevent entry of such particles.

There has thus been described a novel liquid delivery device that controllably delivers a repeatable quantity of the liquid to dysphagic patients or other users. Aspects of a conventional straw are combined with the pump mechanism for conveying liquid from a source to the user. The pump action is provided by movement of a manual actuator. The invention provides for programming of both the size of the bolus, as well as the rate of delivery of the bolus to the user. The liquid delivery device is of a relatively simple design, is inexpensive to manufacture, and may even be formed of disposable parts. Other advantages, and even modifications to the present device will be appreciated by one skilled in the art. The scope of the present invention is not intended to be limited to the specifically disclosed embodiments, but rather is intended to cover any such advantages or modifications as fall within the scope of the appended claims.

What is claimed is:

1. A liquid delivery device for conveying liquid from a liquid source to the mouth of a user, comprising in combination:

a dip tube including first and second ends, the first end being disposed in a liquid source;

a delivery straw including first and second ends, the first end being adapted for receipt in the mouth of the user; and a pumping mechanism including a reservoir having a cylindrical well for retaining a predetermined quantity of the liquid, the pumping mechanism disposed and coupled to the respective second ends of the dip tube and delivery straw so that the cylindrical well is coaxial with the dip tube whereby the liquid flows in a line from the dip tube to the cylindrical well, the pump mechanism also including a manual actuator, the manual actuator being movable from a rest position to an actuated position to cause the predetermined quantity of liquid in the reservoir to be expelled through the delivery straw to the user's mouth, the manual actuator also being movable from the actuated position to the rest position to cause liquid to be drawn from the source through the dip tube to re-fill the reservoir.

2. The liquid delivery device according to claim 1, wherein the pumping mechanism comprises a housing, and a plunger including a circular gasket head having a diameter of the cylindrical well, the plunger being reciprocable within the well, the plunger being coaxial with the cylindrical well.

3. The liquid delivery device according to claim 2, wherein the manual actuator is coupled to the plunger to reciprocate the plunger in the well to provide a pumping action.

4. The liquid delivery device according to claim 2, wherein the plunger includes a central opening in fluid communication with the delivery straw, wherein fluid expelled from the reservoir by movement of the actuator to the actuated position is expelled through the central opening.

5. The liquid delivery device according to claim 1, wherein the pumping mechanism includes a housing having an inlet in fluid communication with the second end of the dip tube, and wherein a one-way valve prevents fluid flow from the reservoir to the dip tube.

6. The liquid delivery device according to claim 1, wherein a one-way valve is disposed between the reservoir and the delivery straw to prevent fluid flow from the delivery straw into the reservoir.

7. The liquid delivery device according to claim 1, wherein the pumping mechanism includes a pump housing, and wherein the actuator is pivotally coupled to the housing for movement between the rest position and the actuated position.

8. The liquid delivery device according to claim 7, wherein a resilient member is disposed between the housing and the actuator, the resilient member being compressed by movement of the actuator to the actuated position, whereby the resilient member restores the actuator to the rest position.

9. The liquid delivery device of claim 8, wherein the resilient member has a stiffness which is selected to provide a delay between movements of the actuator to the actuated position.

10. The delivery device of claim 7, wherein the housing includes a handle having an indentation to receive a thumb of the user.

11. The liquid delivery device according to claim 1, and including a reinforcing sheath surrounding the dip tube to provide stabilizing support to the device.

12. The liquid delivery device according to claim 1, wherein the dip tube is received within a container containing the liquid source, the container providing stabilizing support for the device.

13. The liquid delivery device according to claim 12, wherein the container is a graduated cylinder including volumetric markings to allow determination of the amount of liquid consumed by a user.

14. The liquid delivery device according to claim 1, wherein the dip tube and delivery straw are detachable from the pumping mechanism to allow cleaning and replacement.

15. The liquid delivery device according to claim 1, wherein the delivery straw includes a bend to promote a chin down drinking position.

16. The liquid delivery device according to claim 2, wherein the delivery straw has a ridged surface for gripping by the user.

17. A liquid delivery device for conveying liquid from a liquid source to the mouth of a user, comprising in combination:

a dip tube including first and second ends, the first end having a plurality of lateral openings and being disposed in a liquid source so that the dip tube does not get suctioned to the floor of a container, the dip tube also including a screen across the first end to prevent entry of solid particles into the dip tube;

a delivery straw including first and second ends, the first end being adapted for receipt in the mouth of the user; and a pumping mechanism disposed between and coupled to the respective second ends of the dip tube and delivery straw, the pumping mechanism including a reservoir having a cylindrical wall for retaining a predetermined quantity of the liquid, the pumping mechanism disposed and coupled to the respective second ends of the dip tube and delivery straw so that the cylindrical well is coaxial with the dip tube whereby the liquid flows in a line from the dip tube the cylindrical well, the pumping mechanism also including a manual actuator, the manual actuator being movable from a rest position to an actuated position to cause the predetermined quantity of liquid in the reservoir to be expelled through the delivery straw to the user's mouth, the manual actuator also being movable from the actuated position to the rest position to cause liquid to be drawn from the source through the dip tube to re-fill the reservoir.

18. The liquid delivery device according to claim 17, wherein the pumping mechanism comprises a housing and a plunger including a circular gasket head having a diameter of the cylindrical well, the plunger being reciprocable within the well, and the plunger including a central opening in fluid communication with the delivery straw, wherein fluid expelled from the reservoir by movement of the actuator to the actuated position is expelled through the central opening.

19. A liquid delivery device for conveying liquid from a liquid source to the mouth of a user, comprising in combination:

a dip tube including first and second ends, the dip tube having a screen across the first end to prevent entry of solid particles into the dip tube;

a delivery straw including first and second ends, the first end being adapted for receipt in the mouth of the user; and a pumping mechanism including a reservoir having a cylindrical well for retaining a predetermined quantity of the liquid, the pumping mechanism disposed and coupled to the respective second ends of the dip tube and delivery straw so that the cylindrical well is coaxial with the dip tube whereby the liquid flows in a line from the dip tube to the cylindrical well, the pump mechanism also including a manual actuator, the manual actuator being movable from a rest position to an actuated position to cause the predetermined quantity of liquid in the reservoir to be expelled through the delivery straw to the user's mouth, the manual actuator also being movable from the actuated position to the rest position to cause liquid to be drawn from the source through the dip tube to re-fill the reservoir.

20. The liquid delivery device according to claim 19, wherein the delivery straw has a ridged surface for gripping by the user.

* * * * *

Disclaimer 5,662,268—Kathy Katzenberger, Evanston, IL. THERAPEUTIC DRINKING STRAW MACHINE. Patent dated September 2, 1997. Disclaimer filed April 12, 2002, by assignee Kathy Murray.

Hereby disclaims and dedicates to the Public the entire term of said patent.

*(Official Gazette, July 16, 2002)*